206-526 SR
10/22/85 OR 4,548,322

United States Patent [19]
Cullen et al.

[11] Patent Number: 4,548,322
[45] Date of Patent: Oct. 22, 1985

[54] DUAL COMPARTMENT POWDER CARTRIDGE

[75] Inventors: John S. Cullen, Buffalo; Samuel A. Incorvia; James A. Vogt, both of Tonawanda, all of N.Y.

[73] Assignee: Multiform Desiccants, Inc., Buffalo, N.Y.

[21] Appl. No.: 596,041

[22] Filed: Apr. 2, 1984

[51] Int. Cl.[4] ..... B65D 25/08
[52] U.S. Cl. ..... 206/526; 206/219; 206/484; 383/38; 222/94
[58] Field of Search ..... 206/526, 219, 221, 222, 206/484; 383/36, 38, 906; 222/94, 129

[56] References Cited

U.S. PATENT DOCUMENTS

| | | | |
|---|---|---|---|
| 3,469,768 | 9/1969 | Repko | 383/906 |
| 3,891,138 | 6/1975 | Glas | 206/219 |
| 3,948,704 | 4/1976 | Evans | 222/94 |
| 4,000,996 | 1/1977 | Jordan | 206/219 |
| 4,227,612 | 10/1980 | Dillon | 206/219 |

FOREIGN PATENT DOCUMENTS

| | | | |
|---|---|---|---|
| 133376 | 5/1933 | Austria | 383/38 |

*Primary Examiner*—William T. Dixson, Jr.
*Assistant Examiner*—Brenda J. Ehrhardt
*Attorney, Agent, or Firm*—Joseph P. Gastel

[57] ABSTRACT

A dual compartment powder cartridge including a porous shell formed by fusing the lapped side edge portions of a blank of sheet material to a central portion thereof to form two compartments, a pointed closed first end on the cartridge, powder in the dual compartments, and a sealed second end on the cartridge for closing the compartments. A machine for forming a dual compartment cartridge including a first station for scoring a strip of material with spaced parallel score lines, a second station for folding the strip of material along the score lines to cause opposite edge portions to be placed in lapped engagement with each other and with the central portion of the strip, and a third station for ultrasonically welding the lapped portions to provide a seam between two adjacent compartments. A method of forming a dual compartment powder cartridge consisting of the steps essentially described above relative to the machine, including the additional steps of forming one end of the cartridge to a point and sealing the first end, filling the cartridge with powder, and thereafter sealing the opposite end of the cartridge.

4 Claims, 20 Drawing Figures

Fig. 1.
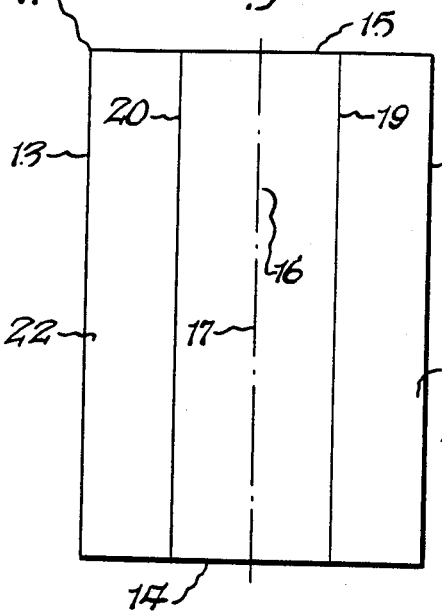
Fig. 2.
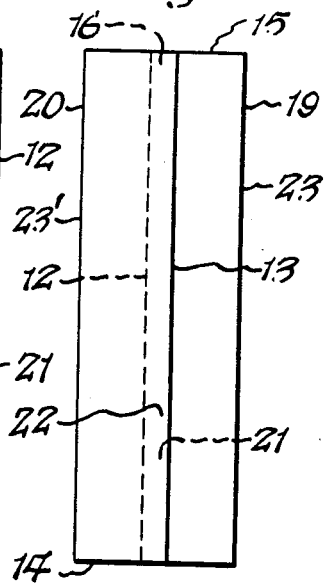
Fig. 3.
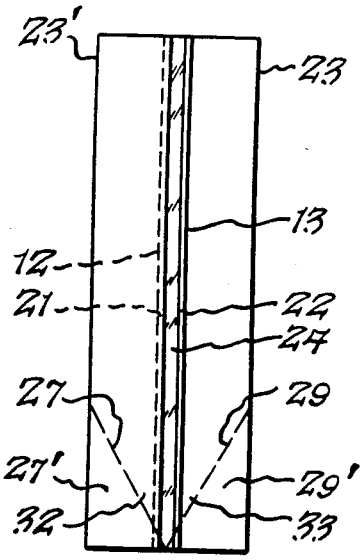
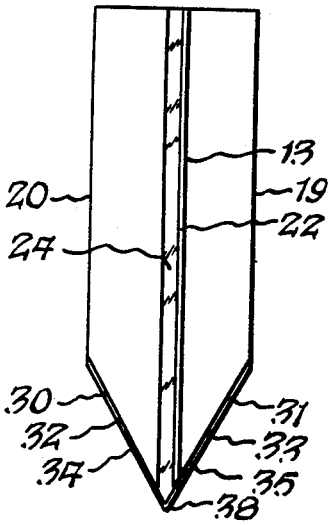
Fig. 4.
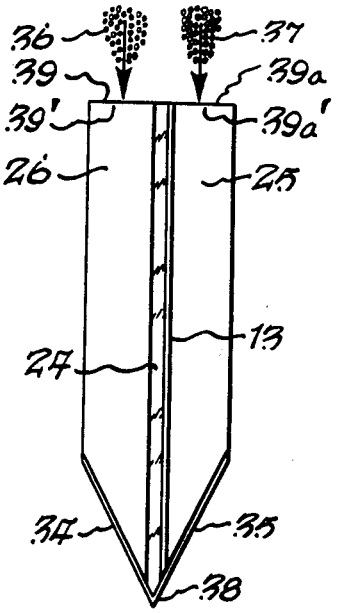
Fig. 5.
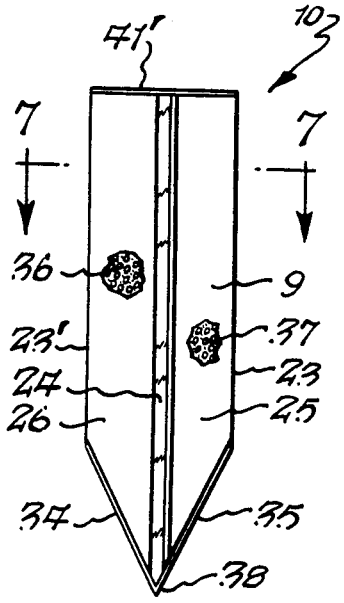
Fig. 6.
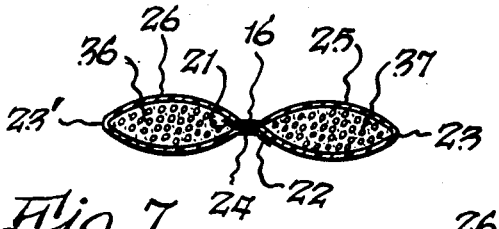
Fig. 7.
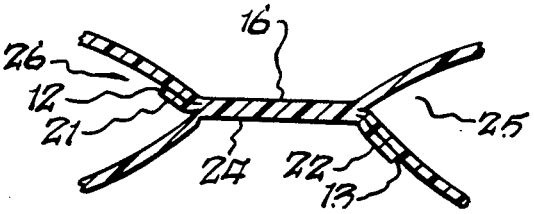
Fig. 8.
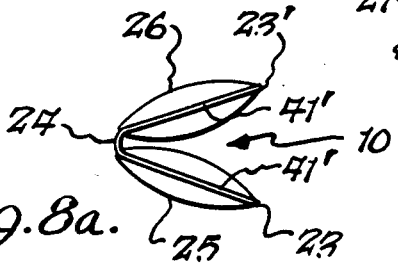
Fig. 8a.

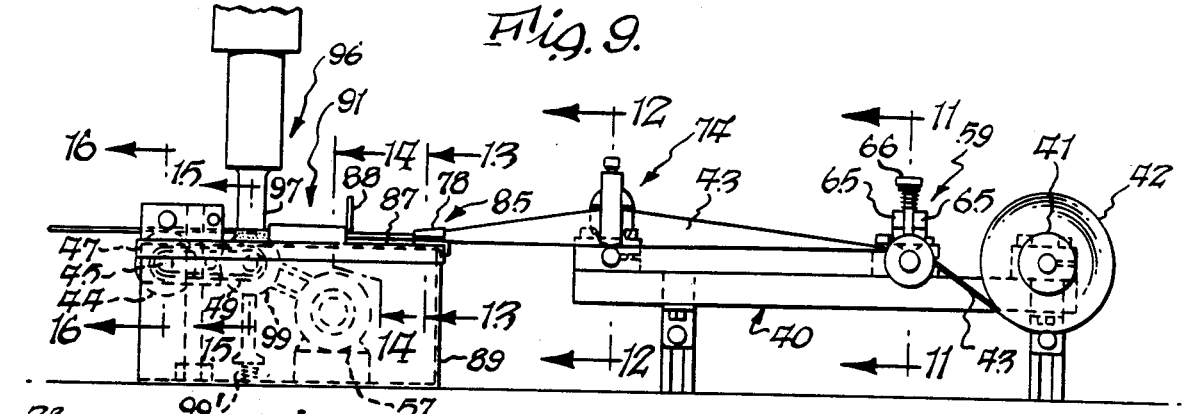
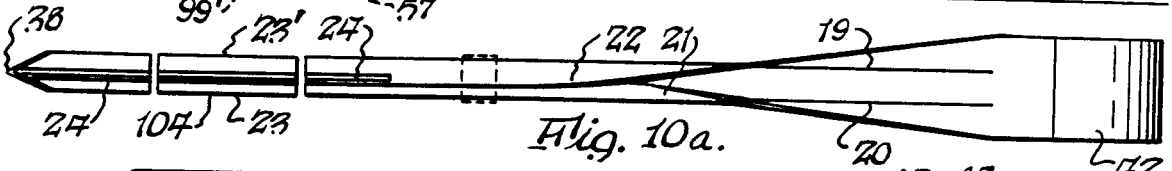
Fig. 10a.
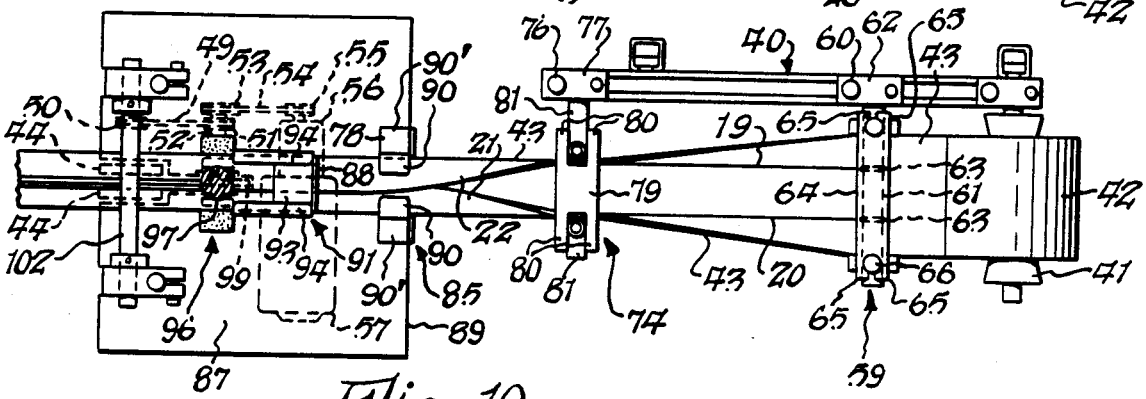
Fig. 10.
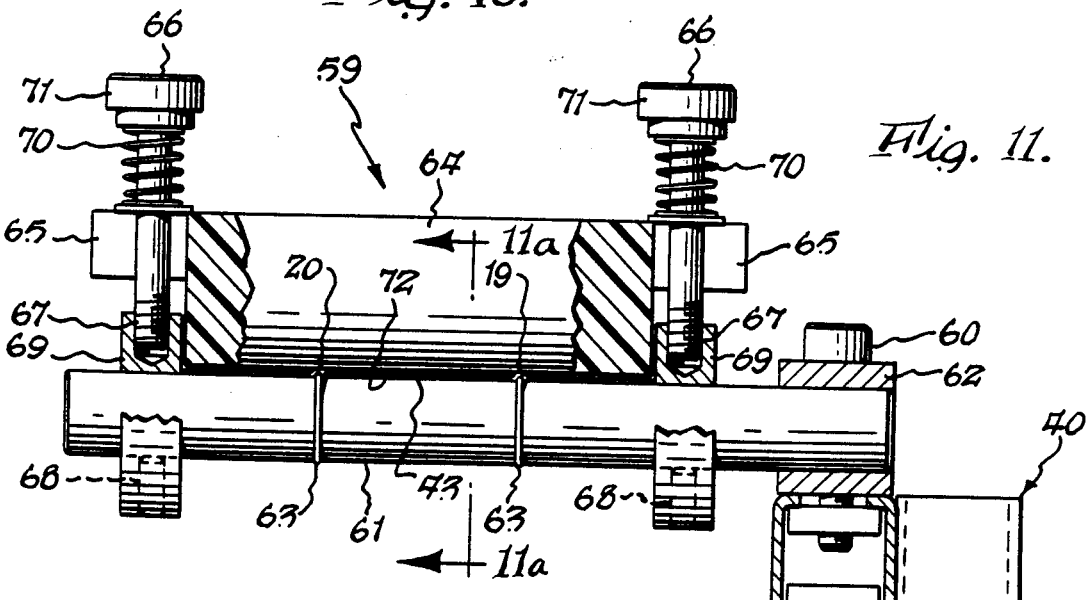
Fig. 11.
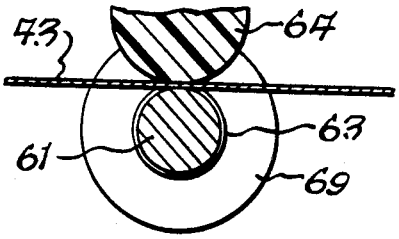
Fig. 11a.

DUAL COMPARTMENT POWDER CARTRIDGE

BACKGROUND OF THE INVENTION

The present invention relates to an improved dual compartment powder cartridge and to a machine and method for fabricating said cartridge.

By way of background, dual compartment powder cartridges were previously known. These cartridges were made by folding a blank over on itself, fusing the mating edges, and thereafter fusing the superimposed sections to provide a seam extending centrally thereof. This structure required two fused seams, each being fused from a double thickness of material. In addition, the seam at the outer edge of the cartridge reduced the capacity of one of the compartments when the center seam was located in the exact center of the cartridge.

SUMMARY OF THE INVENTION

It is one object of the present invention to provide an improved dual compartment powder cartridge which is fabricated with a single centrally located high strength longitudinal seam comprised of three layers of material which is much stronger than the double layer seam of the prior art.

Another object of the present invention is to provide an improved machine for fabricating the improved dual compartment powder cartridge of the present invention.

A further object of the present invention is to provide an improved method for fabricating the improved dual compartment powder cartridge of the present invention. Other objects and attendant advantages of the present invention will readily be perceived hereafter.

The present invention relates a dual compartment powder cartridge comprising a casing fabricated from porous sheet material and having a central longitudinal portion and first and second opposite edges and first and second opposite ends, a pair of folds on said casing located substantially midway between said central longitudinal portion and said first and second edges, first and second edge portions proximate said first and second edges, respectively, lying in superimposed relationship with each other and with said central longitudinal portion, first seam means joining said first and second edge portions and said central longitudinal portion to each other to provide a compartment between said first seam means and said folds, said first and second opposite ends of said sheet material having superimposed first and second end portions, respectively, after said first and second edges and said central portion have been joined by said first seam means, second seam means joining said first end portions of said sheet material to seal first ends of said compartments, third seam means joining said second end portions of said sheet material to seal second ends of said compartments, and powder in said compartments.

The present invention also relates to a machine for fabricating a dual compartment powder-carrying cartridge comprising a base, first means on said base for supporting a roll of strip material having substantially parallel opposite edges and a central portion and first and second edge portions proximate said first and second edges, respectively, second means for scoring said strip material along two score lines substantially parallel to said opposite edges and spaced from said central portion, third means for initially folding said strip material along said two score lines, third means for further folding said strip material to cause said first and second edge portions to lie in superposed relationship to each other and to said central portion, fourth means for bonding said first and second edge portions and said central portion to each other, and fifth means for pulling said strip material through said first, second third and fourth means.

The present invention also relates to a method of fabricating a dual compartment powder cartridge comprising the steps of folding a blank sheet of porous material having first and second substantially parallel opposite edge portions so that substantially parallel opposite edge portions overlie a central portion thereof, bonding said first and second substantially parallel edge portions to each other and to said central portion to produce two side-by-side compartments having first and second ends, first end portions proximate said first end, second end portions proximate said second end, sealing said first end portions to close off said first end, filling said compartments with powder, and sealing said second end portions to close said compartments.

The various aspects of the present invention will be more fully understood when the following portions of the specification are read in conjunction with the accompanying drawings wherein:

BRIEF DESCRIPTION OF THE DRAWINGS

FIG. 1 is a plan view of a porous sheet material blank which is subsequently formed into the dual compartment powder cartridge of the present invention;

FIG. 2 is a plan view of the blank of FIG. 1 in folded condition with its edge portions in superimposed relationship with each other and the central portion of the blank;

FIG. 3 is a view similar to FIG. 2 but showing overlapping edge portions bonded to each other and to the central portion of the blank;

FIG. 4 is a view similar to FIG. 3 and showing one end of the cartridge cut to a point and sealed;

FIG. 5 is a view similar to FIG. 4 and showing powder being inserted into the open end of the cartridge;

FIG. 6 is a view showing the cartridge fully formed with the other end sealed to close the compartments;

FIG. 7 is a cross sectional view taken substantially along line 7—7 of FIG. 6 and showing the dual compartments containing powder and also showing the edge portions bonded to each other and to the central portion of the blank;

FIG. 8 is a fragmentary enlarged view of a portion of FIG. 7;

FIG. 8A is an end view of the cartridge in folded condition;

FIG. 9 is a side elevational view of a machine for fabricating the dual compartment cartridge of the present invention;

FIG. 10 is a plan view of the machine of FIG. 9;

Figure 12:
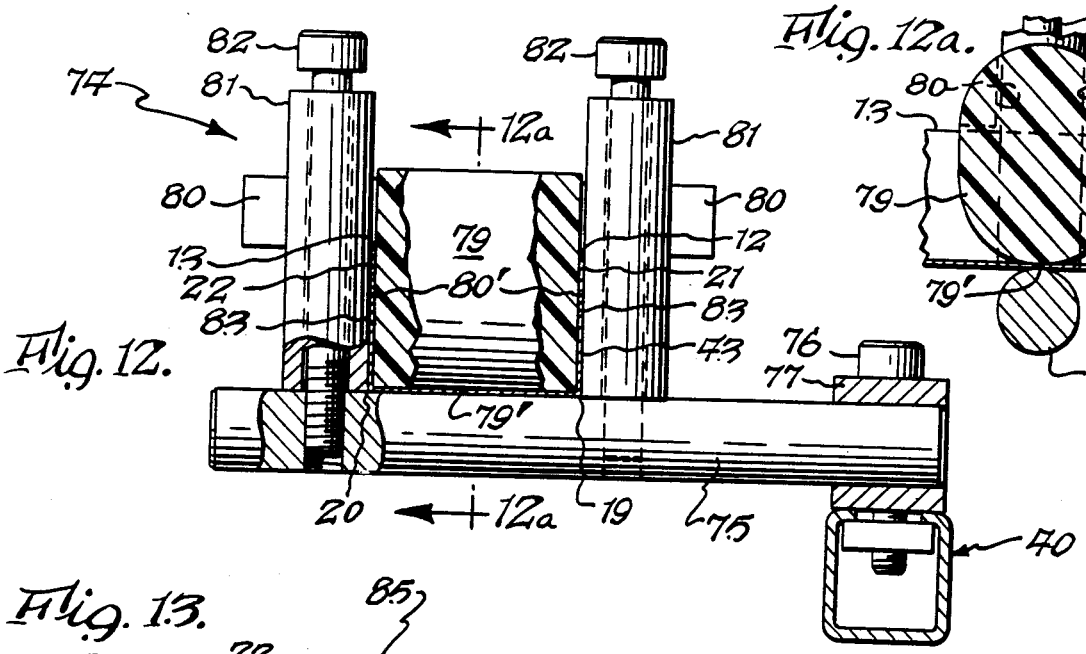
Figure 12A:
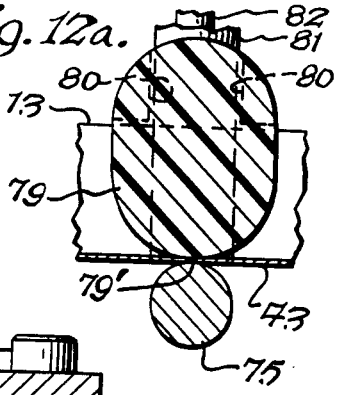
Figure 13:
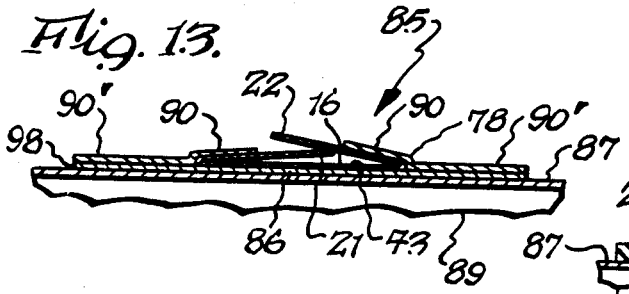
Figure 14:
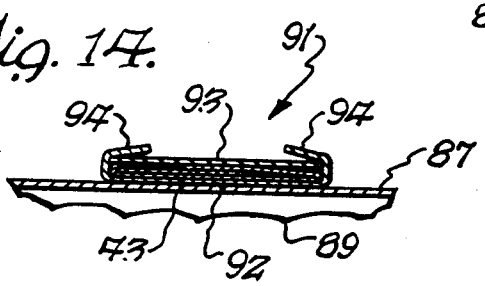
Figure 15:
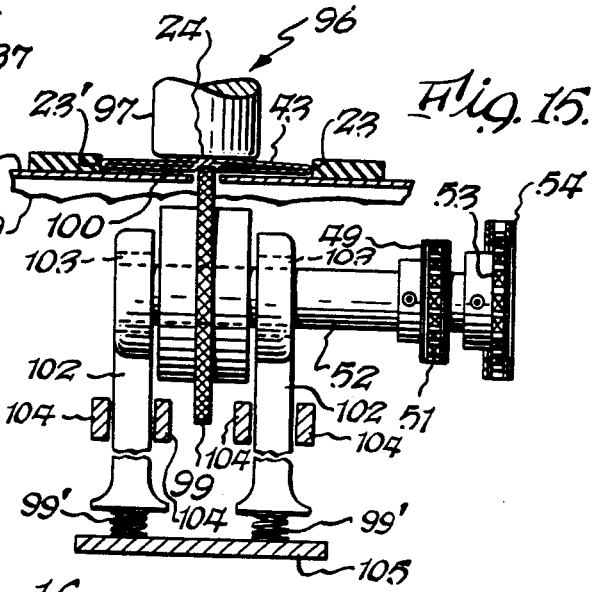
Figure 16:
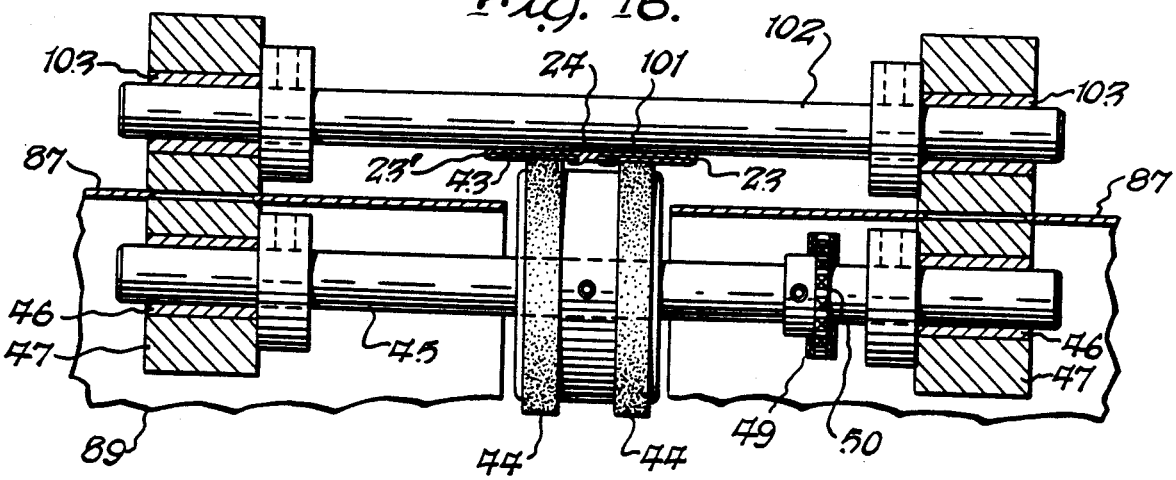

FIG. **10*a*** is a plan view showing the strip of blank material being progressively formed;

FIG. 11 is a fragmentary cross sectional view taken substantially along line 11—11 of FIG. 9 and showing the structure for scoring the strip material;

FIG. **11*a* is a fragmentary cross sectional view taken substantially along line 11*a*—11*a* of FIG. 11**;

FIG. 12 is a cross sectional view, partially broken away, taken substantially along line 12—12 of FIG. 9 and showing the structure for producing the initial fold of the strip material along score lines;

FIG. 12*a* is a fragmentary cross sectional view taken substantially along line 12*a*—12*a* of FIG. 12;

FIG. 13 is a fragmentary cross sectional view taken substantially along line 13—13 of FIG. 9 and showing the next step in folding of the strip material;

FIG. 14 is a fragmentary cross sectional view taken substantially along line 14—14 of FIG. 9 and showing the final step in folding the strip material;

FIG. 15 is a fragmentary cross sectional view taken substantially along line 15—15 of FIG. 9 and showing the edge portions of the strip material being bonded to each other and to the central portion of the strip; and FIG. 16 is a fragmentary cross sectional view taken substantially along line 16—16 of FIG. 9 and showing the feed mechanism associated with the machine.

DESCRIPTION OF THE PREFERRED EMBODIMENTS

Basically the dual compartment cartridge 10 (FIG. 6) includes a casing 9 (FIG. 6) which can be formed from a piece of blank porous sheet material 11 which is a uncoated spun-bonded polyolefin known under the trademark TYVEK. Blank 11 includes side edges 12 and 13 and ends 14 and 15. Blank 11 also includes a central portion 16, which is the area in the vicinity of the longitudinal centerline 17. The blank 11 is folded along fold lines 19 and 20, which are located between centerline 17 and edges 12 and 13, respectively. Edge portions 21 and 22 are immediately adjacent edges 12 and 13, respectively. Fold lines 19 and 20 are preferably scored in advance so that after the blank of FIG. 1 has been folded to the condition of FIG. 2, the outer edges 23 and 23' of the cartridge will be perfectly straight along fold lines 19 and 20. At this time edges 12 and 13 will be located as shown in FIG. 2 with edge portions 22 lying under edge portion 21, and with both of the edge portions overlying central portion 16.

The next step of the fabrication process is to bond overlapping portions 21 and 22 and central portion 16 to each other to provide a seam 24. This is preferably achieved by ultrasonic welding, but it may be achieved in any other desired manner. This step will produce two tubular compartments 25 and 26 (FIGS. 7 and 8). The bonding of the three layers of sheet material at bond 24 is instrumental in providing a strong bond of fused material which is highly resistant to separation. This bond is stronger than can generally be obtained by the fusion of two layers of material because there is more material at the bond.

The next step in the fabrication process is to cut the blank along lines 27 and 29 (FIG. 3), thereby removing the portions 27' and 29', leaving ends 30 and 31. The superimposed end portions 32 and 33 adjacent ends 30 and 31, respectively, are bonded to each other by a suitable fusion process, such as heat sealing, to provide seams 34 and 35. Thereafter, suitable powdered material 36 and 37 is poured into the open upper ends 39 and **39*a*, respectively, of compartments 26 and 25, respectively. This can be done because the superimposed end portions 39' and 39*a'* proximate blank end 15 have not yet been sealed. Thereafter, a seam 41' is made along the top edge of the casing 9** by a suitable fusion process, such as heat sealing, to fully seal the powdered material therein.

The seam 24 provides a longitudinal folding zone for the cartridge 10 so that the cartridge can be doubled over onto itself in the manner shown in FIG. **8*a*. Thus, the dual compartment cartridge 10 can be inserted through a small opening into a container. The point 38 produced by seams 34 and 35** enhances the ease with which the dual compartment cartridge can be inserted through the small opening.

The machine for fabricating the dual compartment cartridge 10 is shown in FIGS. 9–16. The machine includes a base or frame 40 which mounts a reel 41 (FIG. 10) which carries a coil 42 from which strip material 43 is pulled by drive wheels 44 (FIGS. 9, 10 and 16) keyed to shaft 45 journalled in bearings 46 of frame members 47 and driven by chain 49 which encircles sprocket 50 keyed to shaft 45 and also encircles sprocket 51 keyed to shaft 52 (FIGS. 10 and 15) which also has a sprocket 53 keyed thereto and driven by chain 54 which encircles sprocket 55 mounted on the output shaft (not numbered) of gear reducer 56 driven by electric motor 57. Drive wheels 44 are driven at the same peripheral speed as biasing wheel 99 described in detail hereafter.

The strip 43 is initially pulled through a scoring station 59 (FIGS. 9, 10 and 11) secured to base 40 by a nut and bolt assembly 60. The scoring station 59 includes a cylindrical rod 61 which is held against rotation within bracket 62. A pair of spaced annular ridges 63 are located on rod 61. A presser block 64 has ears 65 (FIGS. 9, 10 and 11) on opposite sides thereof which fit loosely about screws 66, and the ends 67 of the screws are received in blocks 69 fixedly mounted on rod 61 by means of set screws 68. Springs 70 are interposed between the heads 71 of screws 66 and ears 65 to bias block 64 downwardly toward rod 61. The strip 43 is pulled through the space between the cylindrical bottom 72 of presser block 64 and cylindrical rod 61. As strip 43 is pulled over ribs 63, it will be scored to form score lines 19 and 20 on its undersurface (FIGS. 1, 10, **10*a* and 11). It will be appreciated that the scoring ribs are circular, and therefore there is tangential contact between the bottom of the presser block, ribs 63 and strip 43. Furthermore, rod 61 can be rotated to bring different portions of the ridges 63 into position in opposition to presser block 64**.

The scored strip 43 is then pulled to a first folding station 74 (FIGS. 9, 10 and 12) wherein the outer edge portions 21 and 21 adjacent outer edges 12 and 13 are folded upwardly about score lines 20 and 19 to the configuration shown in FIG. 12. First folding station 74 includes a base which comprises a cylindrical rod 75 secured to base 40 by a nut and bolt assembly 76 which tightens bracket 77. A folding block 79 has two pairs of ears 80, with each pair loosely bracketing a standard 81 so as to permit block 79 to slide on standards 81. Screws 82 extend through standards 81 to secure them to rod 75. As strip 43 is pulled between the facing inside surfaces 80' of standards 81 and the outside surfaces 83 of block 79 and between the lower cylindrical surface 79' of block 79 and rod 75, the above-described folding shown in FIG. 12 will be obtained.

After leaving the first folding station 74, the strip 43 enters a second folding station 85 which is essentially a funnel-shaped bracket 78 (FIGS. 9, 10 and 13) secured to the top 87 of housing 89 which houses the above-described drive. Portions 90' of side plates 90 of bracket 78 are secured to plate 98 which in turn is secured to base 86. Side plates 90 force the strip 43 to the condition shown in FIG. 13 wherein edge portion 22 is placed in lapped engagement with edge portion 21 and both overlie central portion 16 of the strip.

The strip 43 is then fed into guide 91 (FIGS. 9, 10 and 14) which has a base 92 secured to housing top 87 and has a top plate 93 held in position by flanges 94 which are secured to base 92 as shown in FIG. 14. Top plate 93 has an upstanding end 88 which bears against flanges 94 to prevent plate 93 from moving to the left in FIG. 10. Because strip 43 is pulled through the confined space between plate 93 and base 92, it is folded to its final configuration.

The strip 43 is then pulled through an ultrasonic bonding station 96 (FIGS. 9, 10 and 15) wherein conventional welding element 97 is located in opposition to presser wheel 99 which is spring-biased upwardly by suitable spring mechanisms 99' (FIG. 9) so as to compress the overlapped edge portions 21 and 22 and central portion 16 between wheel 99 and the underside 100 of welding tip 97. Standards 102 which are biased upwardly by springs 99' mounted on base 105 carry bearings 103 in which shaft 52 rotates, and standards 102 are guided for vertical movement by guides 104. The strip 43, is fused to the condition shown in FIG. 3 wherein edges portions 21 and 22 are bonded to each other and to the central portion 16. The strip 43 is pulled through all of the above-described stations by roughened wheels 44 which are pressed against the underside of formed strip 43 (FIG. 16) while the upper side 101 of strip 43 is held against movement by cylindrical rod 102 which rotates in bearings 103.

After strip 43 has been formed in the above-described manner, sections 104 (FIG. 10A) are cut to length to give the blank in the form shown in FIG. 3. Thereafter, the steps described above relative to FIGS. 4, 5 and 6 are performed to produce the finished dual compartment powder cartridge. The cutting to lengths 104 may be performed by automatic cutting machinery (not shown) and the points 38 may also be produced by automatic cutting and fusing machinery. It will be appreciated that the forming steps described above relative to FIGS. 1-6 was to show in detail how a single dual compartment cartridge could be fabricated, but the preferred method is described above relative to the machine of FIGS. 9-16.

The specific dual compartment powder cartridge is intended to contain antimicrobial additive powder, such as tricholosocyanic acid, which will release chlorine gas which passes through the porous walls to produce an antimicrobial action on urine which is collected in the container during catheterization when the cartridge is located in the collecting vessel. However, it will be appreciated that the cartridge can contain two different adsorbents of any type, especially if it is necessary to maintain them separate for optimum adsorption. It will be appreciated that in certain applications a pointed end is not necessary. Therefore, it is within the contemplation of the present invention that both ends of the cartridge can be straight as shown at seam 41, or if desired, the ends may be of any other suitable shape.

While preferred embodiments of the present invention have been disclosed, it will be appreciated that it is not limited thereto but may be otherwise embodied within the scope of the following claims.

What is claimed is:

1. A dual compartment powder cartridge comprising a casing fabricated from porous sheet material and having a central longitudinal portion and first and second opposite edges and first and second opposite ends, a pair of folds on said casing located substantially midway between said central longitudinal portion and said first and second edges, first and second edge portions proximate said first and second edges, respectively, lying in superimposed relationship with each other and with said central longitudinal portion, first seam means joining said first and second edge portions and said central longitudinal portion to each other to provide a compartment between said first seam means and said folds, said first and second opposite ends of said sheet material having superimposed first and second end portions, respectively, after said first and second edges and said central portion have been joined by said first seam means, second seam means joining said first end portions of said sheet material to seal first ends of said compartments, third seam means joining said second end portions of said sheet material to seal second ends of said compartments, and powder in said compartments.

2. A dual compartment powder cartridge as set forth in claim 1 wherein said first ends of said compartments extend at acute angles to said first seam means to form a point.

3. A dual compartment powder cartridge as set forth in claim 2 wherein said first seam means comprises an ultrasonic seal.

4. A dual compartment powder cartridge as set forth in claim 1 wherein said pair of folds are located on score lines.

* * * * *